US012533549B1

(12) United States Patent
Nolan et al.

(10) Patent No.: US 12,533,549 B1
(45) Date of Patent: Jan. 27, 2026

(54) HIP THRUST ATTACHMENT EXERCISE SYSTEM AND METHOD

(71) Applicant: Bulletproof Fitness Equipment Inc, Acton, CA (US)

(72) Inventors: Lawrence R Nolan, Santa Clarita, CA (US); Nicole K Nolan, Santa Clarita, CA (US); Christopher I Gaddy, Brooklyn, NY (US)

(73) Assignee: Bulletproof Fitness Equipment Inc, Acton, CA (US)

( * ) Notice: Subject to any disclaimer, the term of this patent is extended or adjusted under 35 U.S.C. 154(b) by 156 days.

(21) Appl. No.: 18/520,538

(22) Filed: Nov. 27, 2023

Related U.S. Application Data

(60) Provisional application No. 63/502,440, filed on May 16, 2023, provisional application No. 63/428,322, filed on Nov. 28, 2022.

(51) Int. Cl.
*A63B 23/02* (2006.01)
*A63B 21/00* (2006.01)
*A63B 21/06* (2006.01)

(52) U.S. Cl.
CPC ..... *A63B 23/0211* (2013.01); *A63B 21/0615* (2013.01); *A63B 21/4029* (2015.10); *A63B 21/4031* (2015.10); *A63B 21/4033* (2015.10)

(58) Field of Classification Search
CPC ..... A63B 21/0615; A63B 21/4031; A63B 21/4033; A63B 21/062; A63B 21/0622; A63B 21/0624; A63B 21/0626; A63B 21/4007; A63B 21/4009; A63B 21/4029; A63B 21/4047; A63B 21/4049; A63B 23/0211
See application file for complete search history.

(56) References Cited

U.S. PATENT DOCUMENTS

| | | | | |
|---|---|---|---|---|
| 10,226,665 | B2 * | 3/2019 | Kordecki | A63B 21/4031 |
| 11,779,797 | B2 * | 10/2023 | Schneer | A63B 71/0036 482/142 |
| 12,208,305 | B2 * | 1/2025 | Kordecki | A63B 21/4033 |
| 2017/0056708 | A1 * | 3/2017 | Kelly | A63B 23/0233 |
| 2020/0338391 | A1 * | 10/2020 | Hall | A63B 21/0724 |
| 2024/0233998 | A1 * | 7/2024 | Chang | H01F 7/1607 |

* cited by examiner

*Primary Examiner* — Megan Anderson
(74) *Attorney, Agent, or Firm* — Avek IP, LLC

(57) ABSTRACT

A hip thrust attachment exercise system includes a bench, a support system coupled to the bench and having a support bar underneath the bench; and a bench support brace extending from the bench and coupled to the support bar; a first leg and a second leg each extending from the support bar; a weight stand having a first stand leg with a first handle; a second stand leg with a second handle; and a bar extending between the first stand leg and the second stand leg; and a rotational support bracket extending from the bench and coupled to the bar such that the bar can rotate within the rotational support bracket; the weight stand is to be lifted via the first and second handles such that the bar rotates within the rotational support bracket; and once the weight stand is lifted, the user can perform a hip thrust exercise.

18 Claims, 8 Drawing Sheets

HIP THRUST ATTACHMENT EXERCISE SYSTEM AND METHOD

RELATED APPLICATIONS

This application claims priority to U.S. provisional application 63/428,322 filed Nov. 28, 2022, and also claims priority to U.S. provisional application 63/502,440 filed May 16, 2023, both of the foregoing incorporated by reference in their entireties herein.

FIELD OF INVENTION

The disclosure relates generally to exercise equipment. More specifically, the disclosure relates to a hip thrust attachment exercise system that provides for a hip thrust exercise attachment that is configured to secure to one or more vertical posts or be used as a standalone piece of equipment.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

According to an embodiment of the current disclosure, the invention includes a hip thrust attachment exercise system, comprising a bench to support a user thereon and a support system coupled to the bench to support the bench. The support system having a support bar positioned substantially underneath the bench and a bench support brace extending from a bottom surface of the bench and coupled to the support bar. The support system further includes a first leg coupled to a first side of the support bar and extending away therefrom and a second leg coupled to a second side of the support bar and extending away therefrom. A weight stand is configured to provided weighted resistance to the bench, the weight stand having a first stand leg with a first handle, a second stand leg with a second handle, and a bar extending between the first stand leg and the second stand leg. A rotational support bracket extends from the bench and couples to the bar such that the bar can rotate within the rotational support bracket. The weight stand is configured to be lifted via force applied to the first handle and the second handle such that the bar rotates within the rotational support bracket and once the weight stand is lifted, the bench is configured to be raised and lowered via a user performing a hip thrust exercise.

According to another embodiment of the current disclosure, the invention also includes a combination of a support structure and a hip thrust attachment exercise system. The support structure has a first vertical post and a second vertical post, a first J-hook secured to the first vertical post, and a second J-hook secured to the second vertical post. The hip thrust attachment exercise system having a bench to support a user thereon and a support system coupled to the bench to support the bench. The support system has a support bar positioned substantially underneath the bench, and a bench support brace extending from a bottom surface of the bench and coupled to the support bar. A first leg is coupled to a first side of the support bar and extends away therefrom, and a second leg is coupled to a second side of the support bar and extends away therefrom. A weight stand is configured to provide weighted resistance to the bench, the weight stand having a first stand leg with a first handle, a second stand leg with a second handle, and a bar extending between the first stand leg and the second stand leg. A rotational support bracket extends from the bench and couples the bench to the bar such that the bar can rotate within the rotational support bracket. The first J-hook supports the first leg and the second J-hook supports the second leg. The weight stand is configured to be lifted via force applied to the first handle and the second handle such that the bar rotates within the rotational support bracket. Once the weight stand is lifted, the bench is configured to be raised and lowered via a user performing a hip thrust exercise.

BRIEF DESCRIPTION OF THE DRAWINGS

Embodiments of the invention are described in detail below with reference to the attached drawings.

LIST OF REFERENCE NUMBERS

Figure 1:
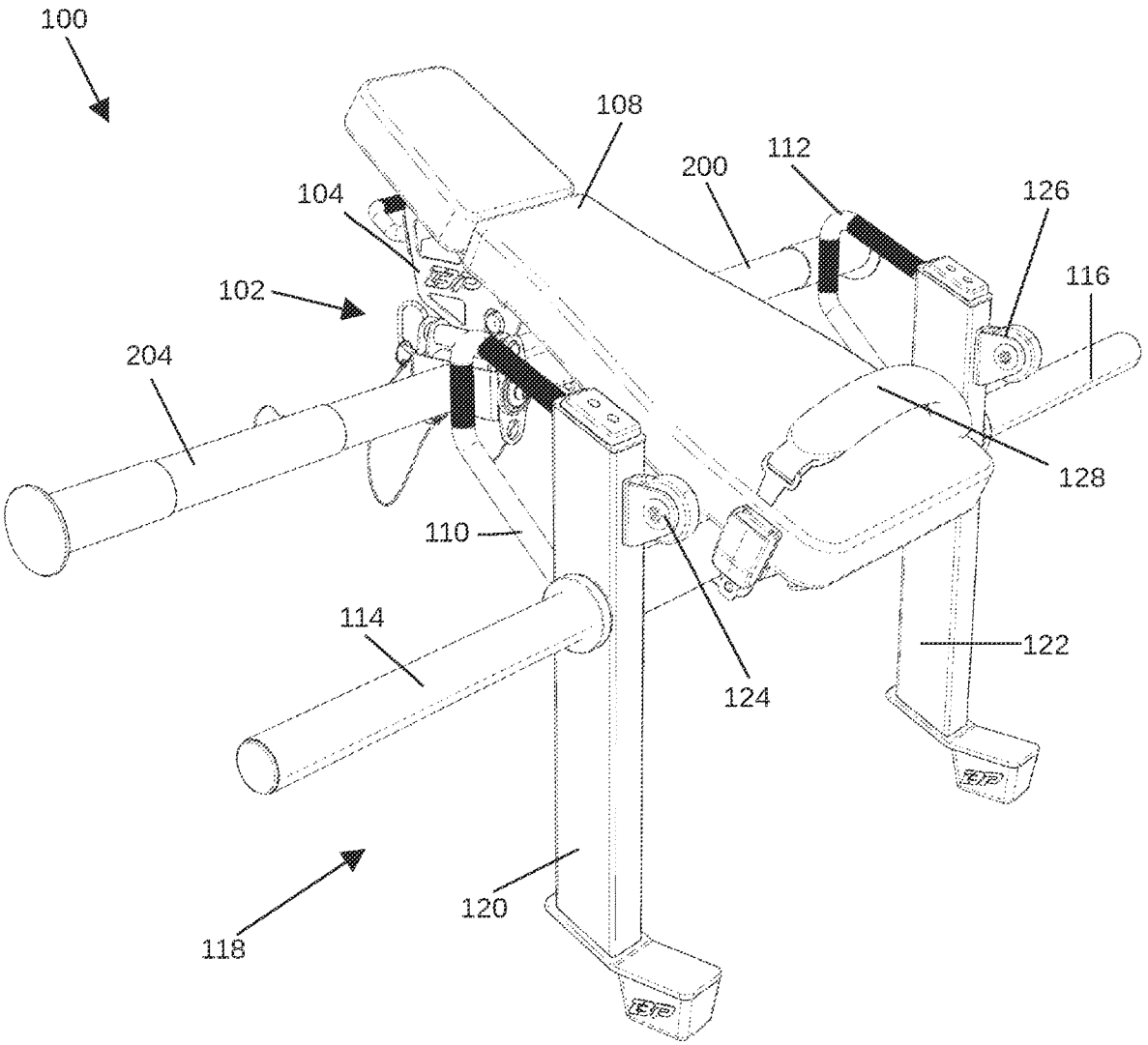
FIG. 1 is a front, angled view of an embodiment of a hip thrust attachment exercise system in accordance with the present disclosure.

100—Hip thrust attachment system
102—Support system
104—Bench support brace
106—Support bar
108—Bench
110—Handle
112—Handle
114—Weight receiver
116—Weight receiver
118—Weight Stand
120—Stand Leg
122—Stand Leg
124—Wheel
126—Wheel
128—Belt
200—First adjustable leg
202—Locking pin
204—Second adjustable leg
206—Locking Pin
208—Rear handle
210—Dual hinge mechanism
212—First hinge
214—Second hinge

216—First hinge bracket with upper openings and lower openings
218—Second hinge bracket with upper openings and lower openings
220—First locking pin
222—Second locking pin
224—Rotational support bracket
226—Arm
228—Stop pad
230—Locking pin
300—Support structure
301—Vertical Posts
302—J-Hook
304—J-Hook
400—Foot plate assembly
402—Foot plate
404—Adjustment system
500—Weight
502—Weight
800—First Curved Support Leg
802—Second Curved Support Leg
804—Support bar bracket with openings The drawings do not limit the invention to the specific embodiments disclosed and described herein. The drawings are not necessarily to scale, emphasis instead being placed upon clearly illustrating various principles of the disclosure.

DETAILED DESCRIPTION

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Exercise equipment is well known in the art and varies from complex machinery to simple devices, wherein a user may select various equipment based on their needs. One type of known exercise is a "hip thrust", for which conventional machines are provided that allow for a user to essentially pivot their hips in an upward direction, with or without weight, to engage their leg muscles. Conventional machines are generally standalone units that take up floor space and a large footprint within a gym or home. Accordingly, it is desirable, and an object of the present invention to provide for a hip thrust attachment exercise system that can be selectively attached to one or more vertical posts. Accordingly, the hip thrust attachment exercise system of the present invention is configured to save floor space and be used alone or with a support structure, thereby providing versatility in use.

The present invention includes a support system that is configured to either attach to a support structure or configured to independently support the hip thrust attachment system depending on the position of a first leg and a second leg. In other words, the first leg and second leg of the present invention are configured to rotate between a first position (for attachment to J-hooks of a support structure) and a second position (wherein the legs extend downward to independently support the hip thrust attachment system). A weight stand 118 is also connected to the bench and can be selectively lifted and lowered by one or more handles, such that when the weight stand 118 is in a lifted position, the hip thrust movement can be performed by the user.

FIGS. 1 through 8 depict various embodiments of the hip thrust attachment system 100 in accordance with the present invention. Those skilled in the art will recognize that the various embodiments shown vary in minor details without departing from the overall intent and operation of the present invention. As shown, the system 100 includes a support system 102 attached to a back/bottom surface of a bench 108 such as via a bench support brace 104. The bench support brace 104 may vary in size and style, as well as in the number of structural components, but regardless provides for coupling of the bench 108 to the support system 102.

Figure 3:
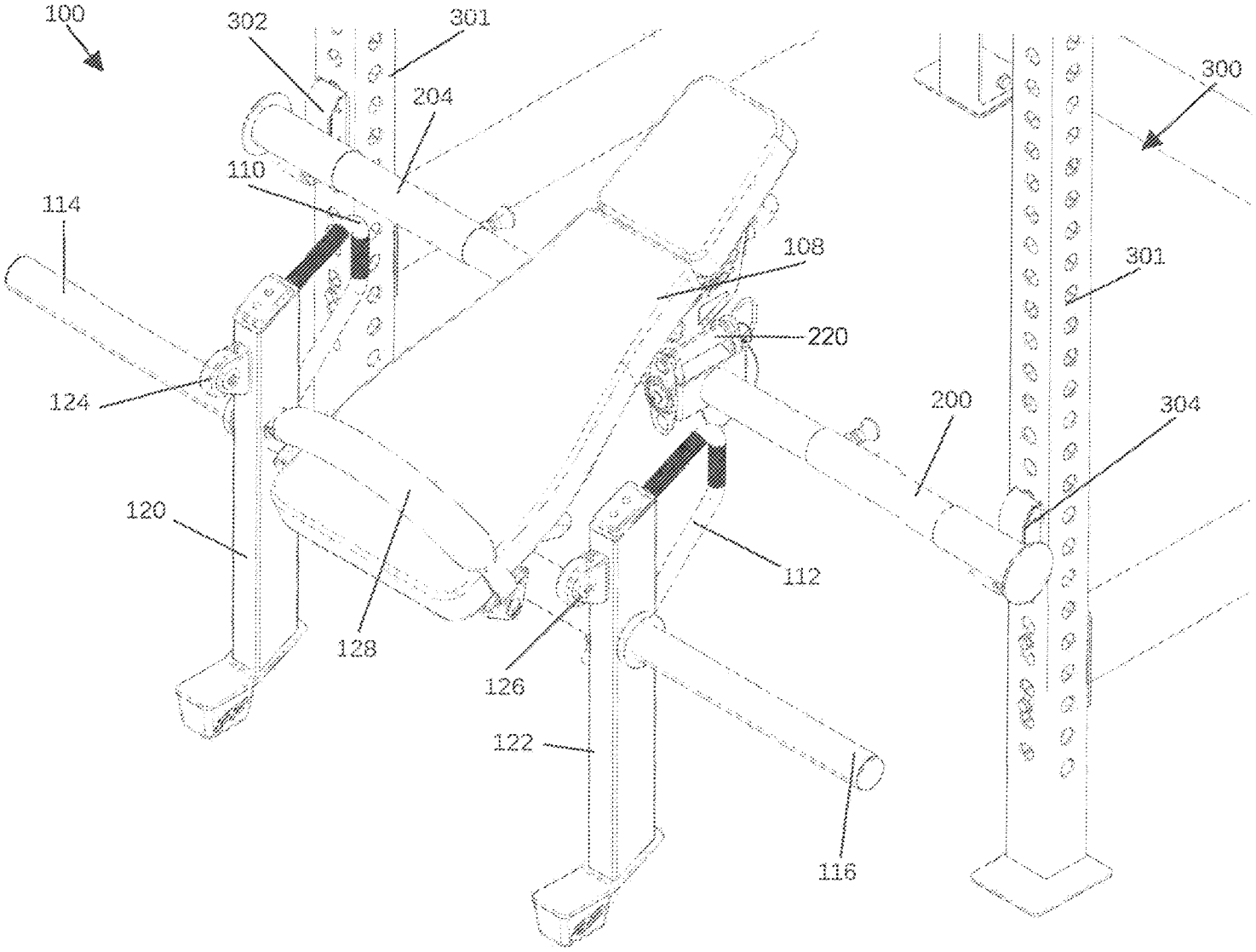
FIG. 3 is front, angled view of an embodiment of a hip thrust attachment exercise system attached to a support structure.
Figure 4:
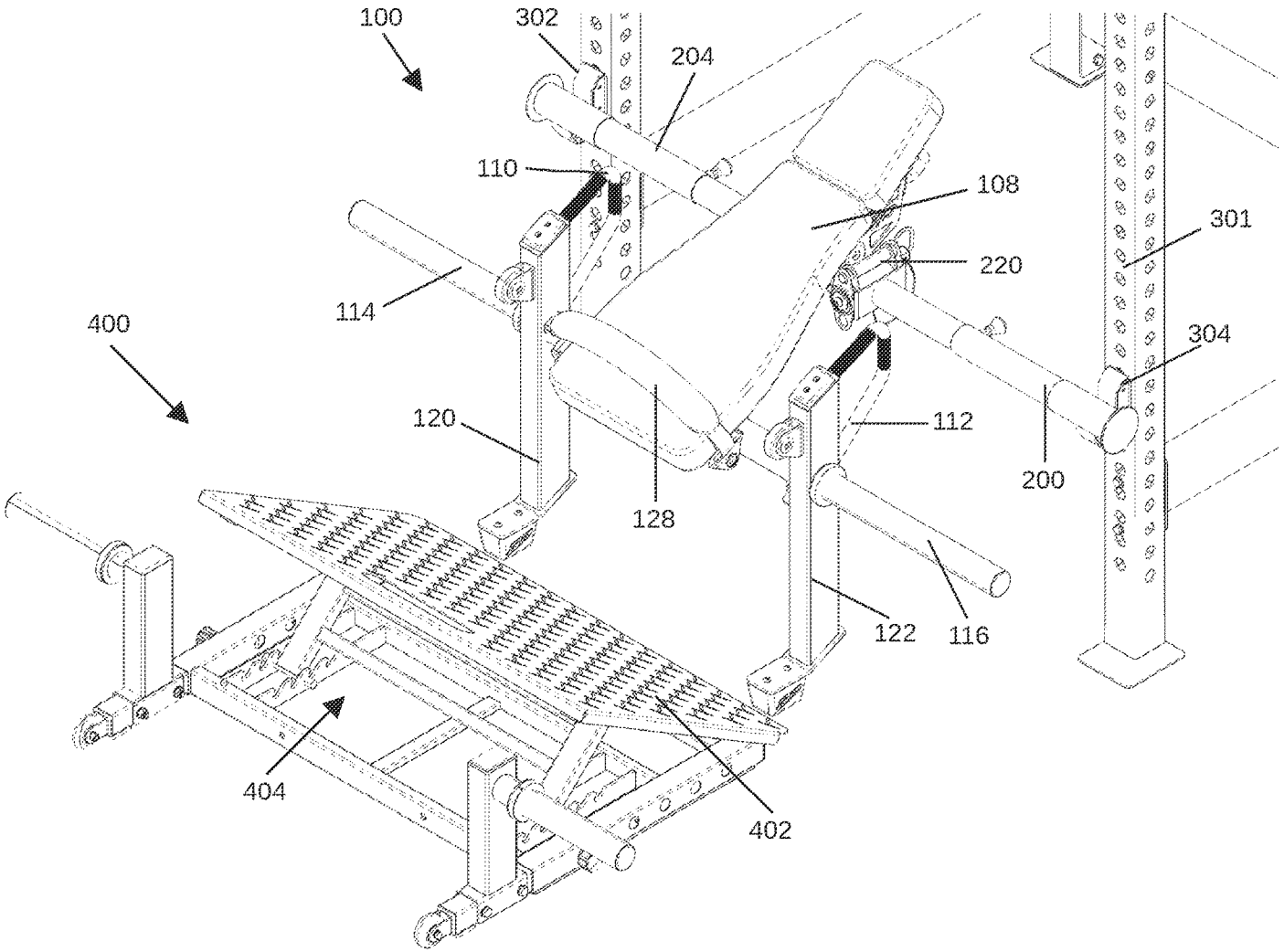
FIG. 4 is a front, angled view of the hip thrust attachment exercise system of FIG. 3 with a foot plate assembly.

The support system 102 includes a support bar 106 that is positioned substantially below the head portion of the bench 108 as shown. The support bar 106 provides for the structural connection between the bench and the remaining support system 102 to hold the bench 108 in the desired and necessary elevation. A first leg 200 extends from the support bar 106 in a first direction and a second leg 204 extends from the support bar 106 in a second direction. As shown, in this first position, the legs 204, 206 are at a zero-degree angle relative to one another as well as relative to the support bar 106. In other words, the legs 204, 206 extend directly out to the side of the bench 108 parallel to a ground surface. In this position, the legs 204, 206 can engage with J-hooks 302, 304 to connect the hip thrust attachment system 100 to the support structure 300 via vertical posts 301. This is best shown in FIGS. 3 and 4.

In some embodiments, each of the legs 204, 206 is independently adjustable in length, such as via telescoping adjustment and locking pins 202, 206. This adjustability provides for dual functions. First, it allows for the system 100 to be attached to support structures of varying sizes, and second, it allows for the height of the bench 108 to be adjusted when the legs 200, 204 are in the second position, discussed in more detail herein and shown in FIG. 8.

Figure 2:
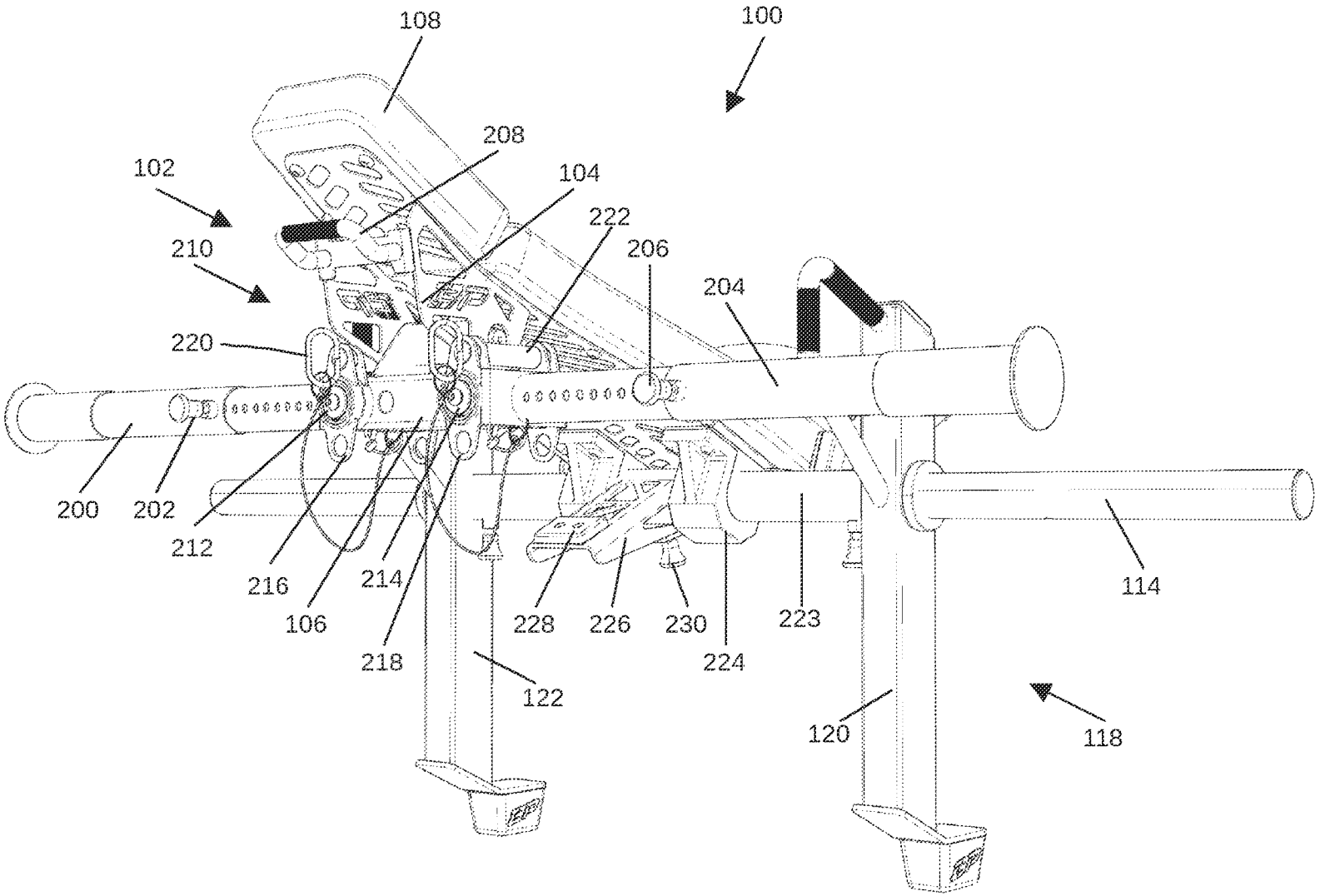
FIG. 2 is a rear, angled view of the hip thrust attachment exercise system of FIG. 1.
Figure 7:
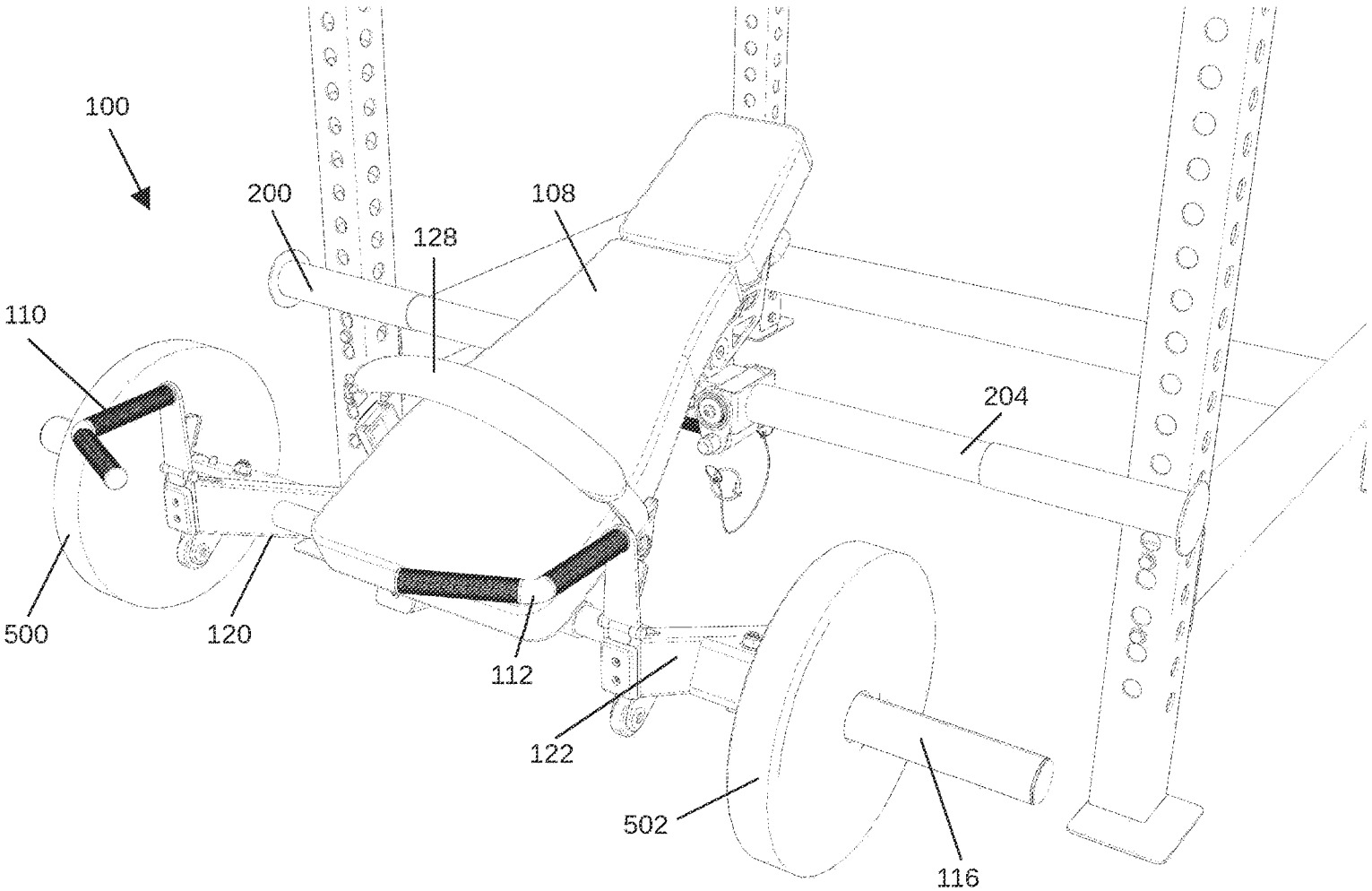
FIG. 7 is a front angled view of an embodiment of a hip thrust attachment exercise system with stand legs in the lifted position.
Figure 8:
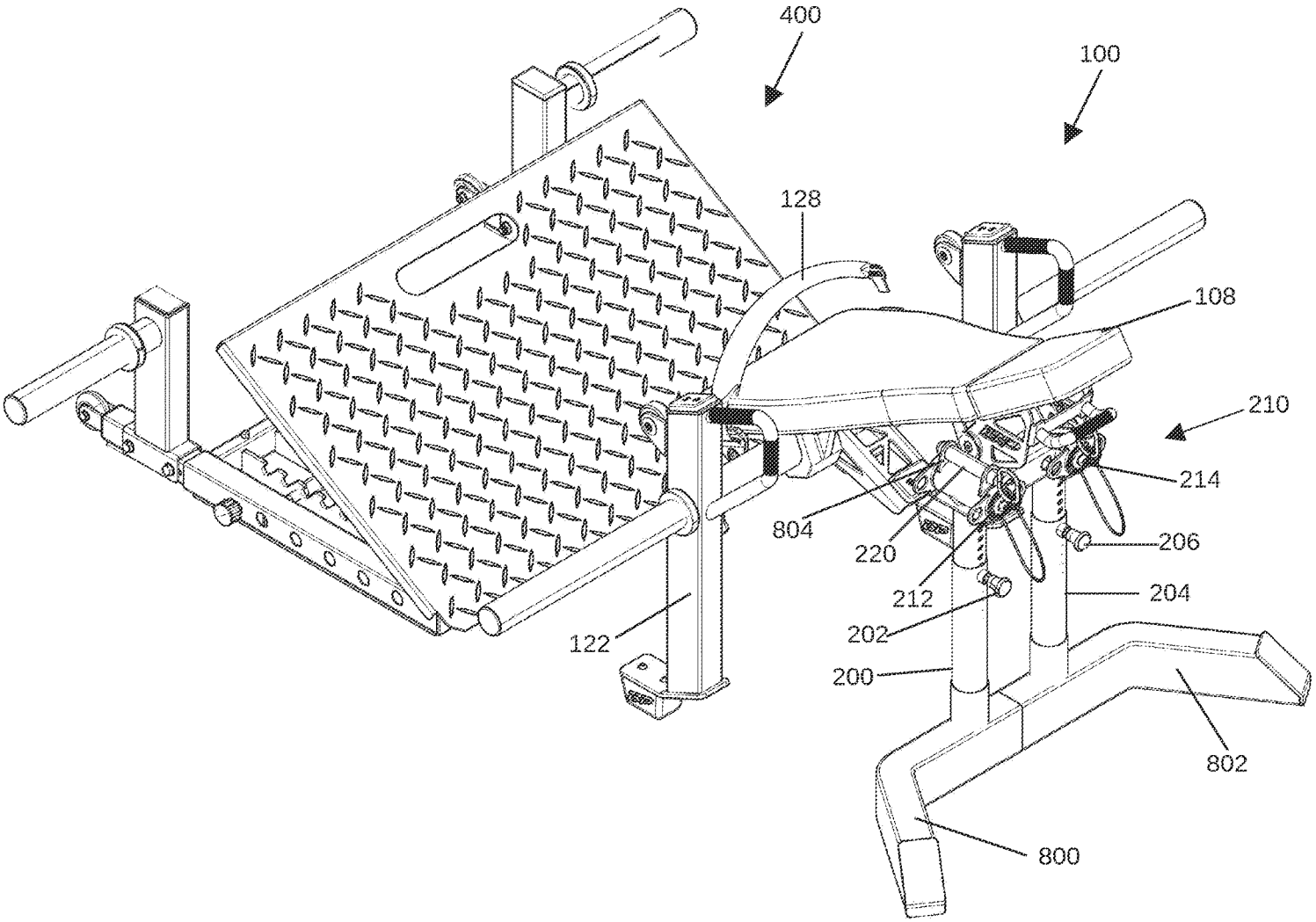
FIG. 8 is a rear angled view of an embodiment of a hip thrust attachment exercise system with adjustable legs rotated to support the hip thrust attachment exercise system.

The support system 102 further includes a dual hinge mechanism 210 that provides the means for the legs 200, 204 to adjust between the first position (FIGS. 1-7) and the second position (FIG. 8). The dual hinge mechanism 210 includes a first hinge 212 that couples the first leg 200 to the support bar 106 and a second hinge 214 that couples the second leg 204 to the support bar 106. Locking pins 220, 222 are used to lock the legs 200, 204 into at least the first position. As best shown in FIG. 2, a first hinge bracket 216 extends from the first hinge 212 and therefore rotates with the first hinge 212. Similarly, a second hinge bracket 218 extends from the second hinge 218 and accordingly rotates with the second hinge 218. Each hinge bracket 216, 218 includes two aligned upper openings and two aligned lower openings as shown. Specifically, in FIG. 2, the aligned upper openings are above the support bar 106 and the aligned lower openings are below the support bar 106. As best shown in FIG. 8, support brackets, for example a first support bar bracket 804 extends from the support bar 106. Accordingly, openings of the support bar bracket 804 align with upper openings of the first hinge bracket 216 when in the first position (see FIG. 2). The first locking pin 220 extends through these aligned openings to lock the first leg 200 at zero degrees relative to the second leg 204 and the support bar 106. The locking pin 220 can then be removed and the first leg 200 can rotate via the first hinge 212 into the second position (see FIG. 8) such that now the first leg 200 extends straight down to the ground surface and supports the bench there above. Those skilled in the art will appreciate that the second leg 204 is moveable between positions in the same manner as the first leg 200. This dual hinge mechanism 210 allows for the system 100 to be either attached to a support structure, or be used independently based on the needs of the user.

Figure 5:
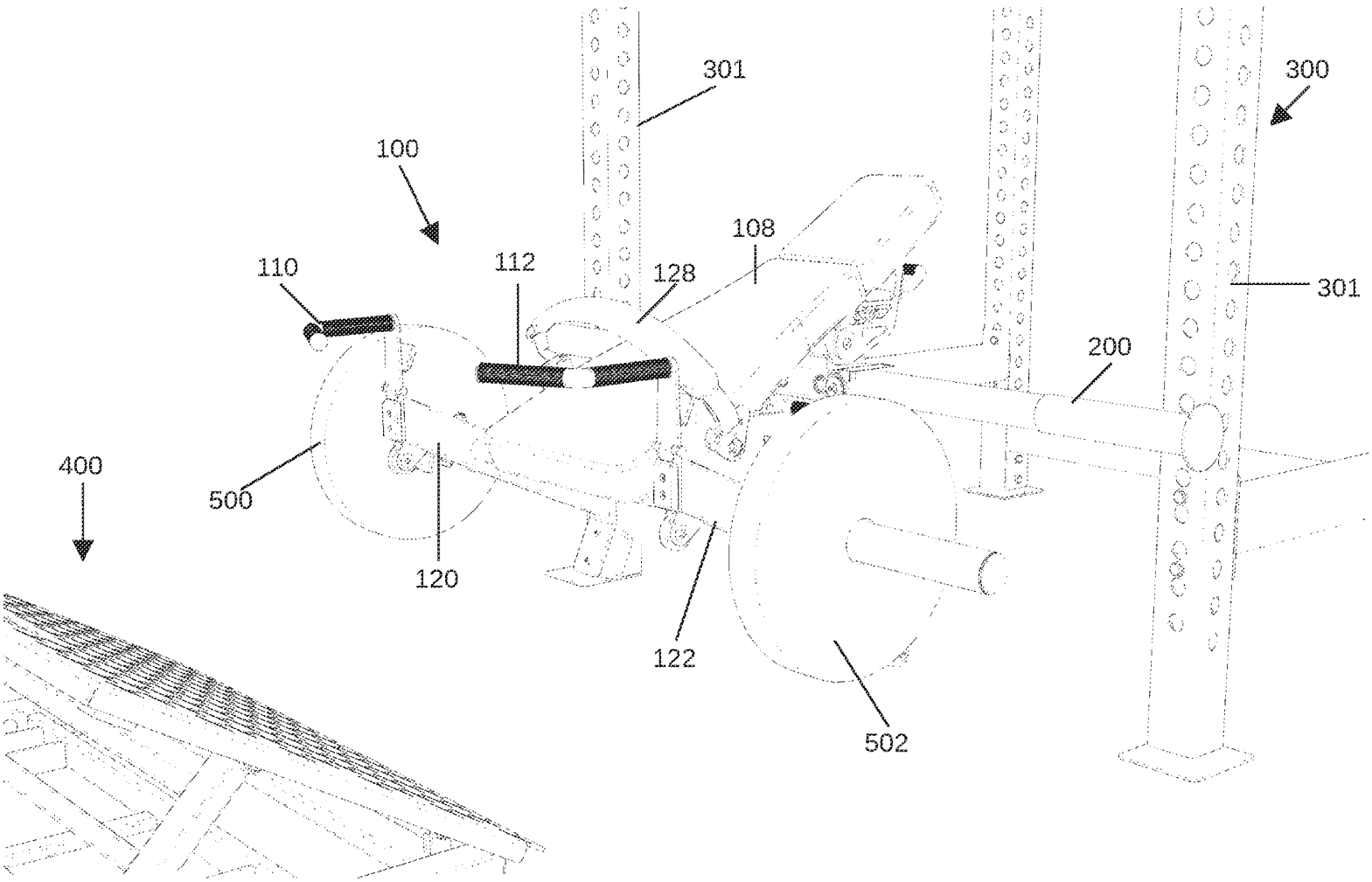
FIG. 5 is an angled view of the hip thrust attachment exercise system of FIG. 3 with the foot plate assembly and with stand legs in a lifted position.
Figure 6:
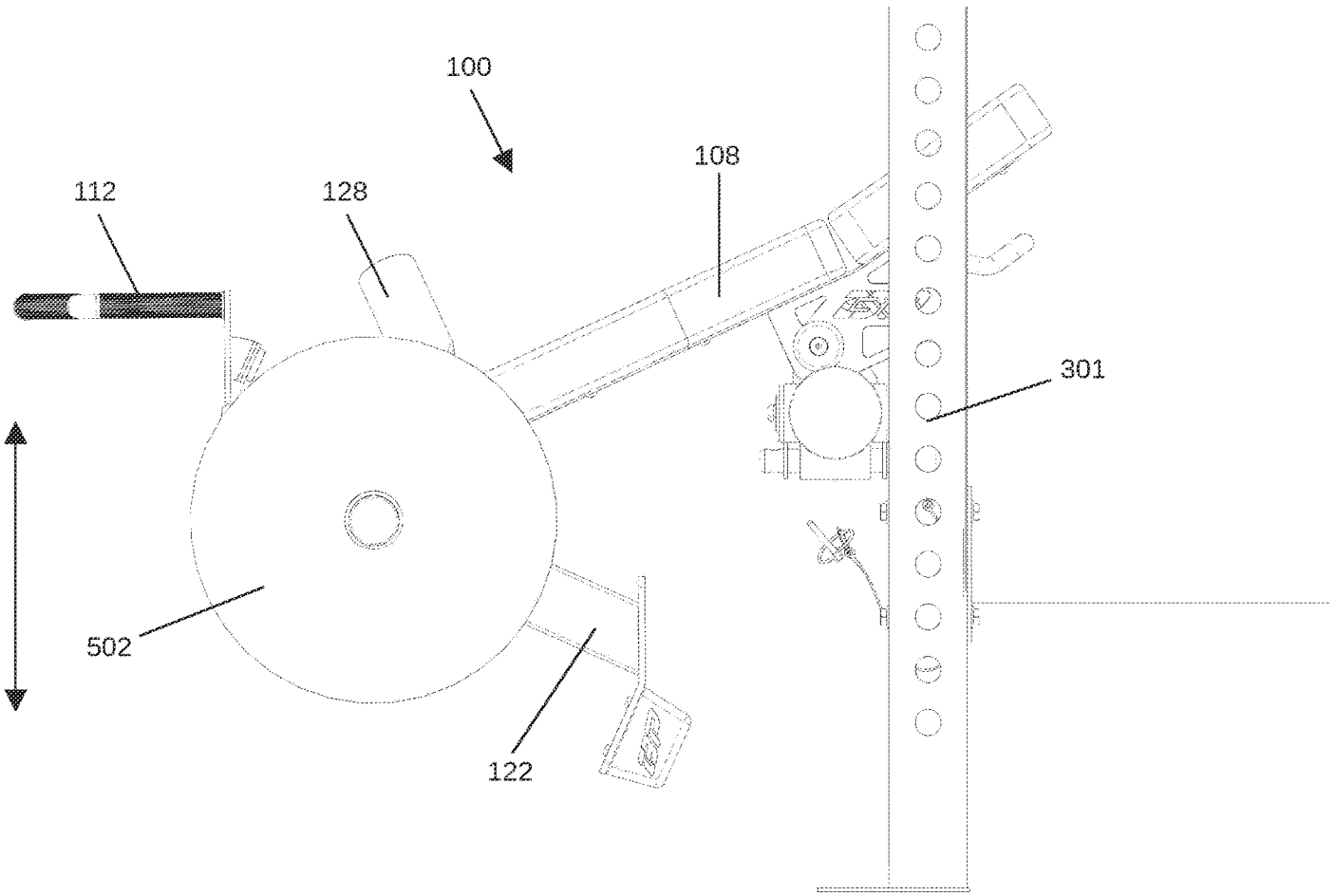
FIG. 6 is a side view of the hip thrust attachment exercise system of FIG. 3 with the stand legs in the lifted position.

System 100 further includes a weight stand 118 composed of a first stand leg 120 and a second stand leg 122. Each leg is attached to a bar 223 that extends between each leg 120, 122 and couples them to the bench 108. Specifically, a rotational support bracket 224 is used to couple the bench 108 to the bar 223 such that the bar 223 can rotate within the bracket 224. In other words, the bracket 224 is designed such that the bar 223 is not fixed thereto, but rather can rotate. A first handle 110 extends from the first leg 120 and a second handle 112 extends from the second leg 122. As shown in the various embodiments, the handles 110, 112 can vary in shape. During use, the user will lie on the bench 108 and push the handles 110, 112 forward, which then applies force to the legs 120, 122 to rotate the legs upward via the bar 223 and bracket 224. This is best shown in FIGS. 5, 6, and 7. The legs 120, 122 will remain pivoted upwards as the user continues to apply said force such that the bench 108 is free to drop toward the ground surface. Accordingly, the user will be able to support themselves with their legs resting on either the ground surface or on a foot plate assembly 400 and perform hip thrusting exercises.

In embodiments, an arm 226 is rigidly attached to the bar 223 and extends to an end with a stop pad 228, accordingly, as the legs 120, 122 are pushed backwards and the bar 223 rotates, the arm 226 will pivot upwards and the stop pad 228 will come into contact with the bench 108.

Embodiments may also include a rear handle 208 extending from the bench 108 to allow for the user to easily maneuver the hip thrust attachment system 100. And yet further, in some embodiments, wheels 124, 126 are attached to the legs 120, 122 to allow for the system to be easily rolled from one location to another.

A belt 128 or other strap extends over the top surface of the bench 108. Those skilled in the art will appreciate that the belt 128 may be adjustable and vary in style and aesthetics.

In FIGS. 4, 5, and 8, the system 100 is shown with the foot plate assembly 400. The foot plate assembly 400 can be used with the system, or the system 100 can be used independently of the foot plate assembly. Again, those skilled in the art will appreciate that the foot plate assembly can vary, including a foot plate 402 and an adjustment system 404 to allow a user to further customize their workout.

One or more weights 500, 502 can be added to weight receivers 114, 116 to increase the resistance associated with the hip thrust exercise. The weight receivers 114, 116 can extend directly from the legs 120, 122 such that the entire weight stand is coupled to the underneath side of the bench.

Lastly, turning to FIG. 8, which demonstrates the use of the hip thrust attachment system 100 as a stand-alone unit. Here, the legs 200, 204 are rotated into the second position, namely extending downward to the ground. Although the legs 200, 204 may independently support the hip thrust attachment system 100, additional curved support legs 800, 802 may be added to increase stability of the system.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations. Not all steps listed in the various figures need be carried out in the specific order described.

The invention claimed is:

1. A hip thrust attachment exercise system, comprising:
- a bench to support a user thereon;
- a support system coupled to the bench to support the bench, the support system having:
  - a support bar positioned underneath the bench; and
  - a bench support brace extending from a bottom surface of the bench and coupled to the support bar;
- a first leg coupled to a first side of the support bar and extending away therefrom;
- a second leg coupled to a second side of the support bar and extending away therefrom;
- a weight stand configured to provided weighted resistance to the bench, the weight stand having:
  - a first stand leg with a first handle;
  - a second stand leg with a second handle; and
  - a bar extending between the first stand leg and the second stand leg; and
- a rotational support bracket extending from the bench and coupled to the bar such that the bar is configured to rotate within the rotational support bracket;
- wherein the weight stand is configured to be lifted via force applied to the first handle and the second handle such that the bar rotates within the rotational support bracket; and
- wherein once the weight stand is lifted, the bench is configured to be raised and lowered via the user performing a hip thrust exercise.

2. The hip thrust attachment exercise system of claim 1, further comprising a dual hinge mechanism having a first hinge coupling the first leg to the support bar and a second hinge coupling the second leg to the support bar, wherein the first leg and the second leg are configured to rotate between a first position and a second position.

3. The hip thrust attachment exercise system of claim 2, wherein the dual hinge mechanism further comprises a first locking pin to lock the first leg in one of the first position and the second position and a second locking pin to lock the second leg in one of the first position and the second position.

4. The hip thrust attachment exercise system of claim 3, further comprising:
- a first bracket rotationally coupled to the first hinge;
- a first support bar bracket;
- wherein the first support bar bracket remains stationary;
- wherein the first bracket rotates with the first hinge;
- wherein when the first leg is in the first position the locking pin extends through both the first bracket and the first support bar bracket to lock the first leg into the first position; and
- wherein when the first leg is in the second position the locking pin only extends through the first bracket.

5. The hip thrust attachment exercise system of claim 2, wherein the first position is defined as the first leg and the second leg extending outward from the bench such that the first leg and the second leg are at zero degrees relative to the support bar and the second position is defined as the first leg and the second leg extending downward from the bench such that the first leg and the second leg are at ninety degrees relative to the support bar.

6. The hip thrust attachment exercise system of claim 1, wherein the weight stand further comprises a first weight receiver extending away from the first stand leg and a second weight receiver extending from the second stand leg.

7. The hip thrust attachment exercise system of claim 1, wherein the first handle extends in a direction behind the first stand leg and parallel with the bench such that the first handle does not extend over a top surface of the bench.

8. The hip thrust attachment exercise system of claim 1, wherein the weight stand further comprises a first wheel attached to the first stand leg and a second wheel attached to the second stand leg.

9. The hip thrust attachment exercise system of claim 1, wherein the weight stand further comprises an arm coupled to the bar and extending in a rearward direction, the arm having a stop pad attached thereto, wherein the stop pad is configured to come into contact with the bottom surface of the bench when the weight stand is raised into a lifted position.

10. The hip thrust attachment exercise system of claim 1, wherein the first leg and the second leg are adjustable in length.

11. A combination of a support structure and a hip thrust attachment exercise system, the combination comprising:

the support structure having a first vertical post and a second vertical post, a first J-hook secured to the first vertical post and a second J-hook secured to the second vertical post;

the hip thrust attachment exercise system having:

a bench to support a user thereon;

a support system coupled to the bench to support the bench, the support system having a support bar positioned underneath the bench, and a bench support brace extending from a bottom surface of the bench and coupled to the support bar;

a first leg coupled to a first side of the support bar and extending away therefrom;

a second leg coupled to a second side of the support bar and extending away therefrom;

a weight stand configured to provided weighted resistance to the bench, the weight stand having a first stand leg with a first handle, a second stand leg with a second handle, and a bar extending between the first stand leg and the second stand leg; and a rotational support bracket extending from the bench and coupled to the bar such that the bar is configured to rotate within the rotational support bracket;

wherein the first J-hook supports the first leg and the second J-hook supports the second leg;

wherein the weight stand is configured to be lifted via force applied to the first handle and the second handle such that the bar rotates within the rotational support bracket; and wherein once the weight stand is lifted, the bench is configured to be raised and lowered via the user performing a hip thrust exercise.

12. The combination of claim 11, wherein the weight stand further comprises a first weight receiver extending away from the first stand leg and a second weight receiver extending form the second stand leg.

13. The combination of claim 11, wherein the first handle extends in a direction behind the first stand leg and parallel with the bench such that the first handle does not extend over a top surface of the bench.

14. The combination of claim 11, wherein the weight stand further comprises a first wheel attached to the first stand leg and a second wheel attached to the second stand leg.

15. The combination of claim 11, wherein the weight stand further comprises an arm coupled to the bar and extending in a rearward direction, the arm having a stop pad attached thereto, wherein the stop pad is configured to come into contact with the bottom surface of the bench when the weight stand is raised into a lifted position.

16. The combination of claim 11, further comprising a dual hinge mechanism having a first hinge coupling the first leg to the support bar and a second hinge coupling the second leg to the support bar.

17. The combination of claim 11, wherein the dual hinge mechanism further comprises a first locking pin to lock the first leg in a position relative to the support bar and a second locking pin to lock the second leg in a position relative to the support bar.

18. The combination of claim 11, wherein the first leg and the second leg are adjustable in length.

* * * * *